US012721434B2

(12) United States Patent
Hwu

(10) Patent No.: US 12,721,434 B2
(45) Date of Patent: Sep. 1, 2026

(54) STORAGE SYSTEM COMPRISING A PLURALITY OF CONNECTABLE PLATE-SHAPED MEMBERS

(71) Applicant: Inter IKEA Systems B.V., Delft (NL)

(72) Inventor: Han Hwu, Lund (SE)

(73) Assignee: Inter IKEA Systems B.V., Delft (NL)

( * ) Notice: Subject to any disclaimer, the term of this patent is extended or adjusted under 35 U.S.C. 154(b) by 68 days.

(21) Appl. No.: 18/257,082

(22) PCT Filed: Dec. 14, 2021

(86) PCT No.: PCT/SE2021/051248
§ 371 (c)(1),
(2) Date: Jun. 12, 2023

(87) PCT Pub. No.: WO2022/132004
PCT Pub. Date: Jun. 23, 2022

(65) Prior Publication Data

US 2024/0090663 A1 Mar. 21, 2024

(30) Foreign Application Priority Data

Dec. 14, 2020 (SE) ..... 2051454-3

(51) Int. Cl.
*A47B 88/994* (2017.01)
*A47B 88/919* (2017.01)

(52) U.S. Cl.
CPC ..... *A47B 88/919* (2017.01)

(58) Field of Classification Search
CPC .... A47B 88/919; A47B 88/969; A47B 88/994
(Continued)

(56) References Cited

U.S. PATENT DOCUMENTS 3,497,081 A * 2/1970 Field ..... A47B 57/58 211/184
3,501,019 A * 3/1970 Armstrong ..... A47B 57/58 211/184

(Continued)

FOREIGN PATENT DOCUMENTS

CH 317063 A 11/1956
DE 2516843 A1 10/1976

(Continued)

*Primary Examiner* — James O Hansen
(74) *Attorney, Agent, or Firm* — Capitol City TechLaw

(57) ABSTRACT

The invention relates to a storage system (2) for storing items, wherein the storage system comprises a plurality of plate-shaped members (4, 6, 8), wherein each one of the plate-shaped members comprises an upper support surface for supporting said items. Each one of two of the plate-shaped members (4, 6, 8) comprises an engagement structure provided at an edge of the plate-shaped member, wherein the engagement structures are of complimentary shape and dimension for engagement, and wherein the plate-shaped members (4, 6, 8) are arrangeable side by side with the engagement structures in engagement so that the plate-shaped members jointly form a continuous sheet, wherein a first one (4) of the plate-shaped members comprises a first engagement structure (34) provided at an edge of the first plate-shaped member, wherein a second one (6) of the plate-shaped members comprises a second engagement structure (36) provided at an edge of the second plate-shaped member, and wherein the first engagement structure and the second engagement structure are of complimentary shape and dimension for allowing engagement, characterized in that each one of the first plate-shaped member (4) and the second plate-shaped member (6) is defined by an edge (42, 44) extending along a straight line at an opposite side of the respective plate-shaped member in relation to the engagement structure (34, 36), and wherein a
(Continued)

third one (8) of the plate-shaped members comprises a third engagement structure (38) provided at an edge of the third plate-shaped member and a fourth engagement structure (40) provided at an edge of the third plate-shaped member, wherein the third engagement structure (38) and the fourth engagement structure (40) face in opposite directions, wherein the third engagement structure (38) and the first engagement structure (34) are of complimentary shape and dimension for allowing engagement, and wherein the fourth engagement structure (40) and the second engagement structure (36) are of complimentary shape and dimension for allowing engagement.

14 Claims, 10 Drawing Sheets

(58) Field of Classification Search
USPC ..... 312/348.3; 220/528
See application file for complete search history.

(56) References Cited

U.S. PATENT DOCUMENTS

| | | | | | |
|---|---|---|---|---|---|
| 5,211,458 | A * | 5/1993 | Yale | A47B 88/90 | 283/117 |
| 5,328,048 | A * | 7/1994 | Stein | B65D 43/16 | 220/651 |
| 5,800,031 | A * | 9/1998 | Hanneman | A47B 88/90 | 312/348.3 |
| 6,634,728 | B1 * | 10/2003 | Leguin | B25H 3/028 | 312/351 |
| 7,424,958 | B1 * | 9/2008 | Eley | A47F 5/0815 | 211/70.6 |
| 7,861,860 | B2 * | 1/2011 | Bettenhausen | A61L 2/26 | 206/439 |
| 8,286,828 | B2 * | 10/2012 | Schafer | B65D 11/18 | 220/826 |
| 10,716,399 | B2 * | 7/2020 | Brown | A47B 88/90 | |
| 10,842,303 | B1 | 11/2020 | Vieveen | | |
| 2008/0083753 | A1 * | 4/2008 | Escobar | A47B 88/994 | 220/8 |
| 2009/0159541 | A1 * | 6/2009 | Burgess | A47B 88/90 | 312/348.3 |
| 2011/0084584 | A1 * | 4/2011 | Curtin | A47B 97/00 | 312/348.3 |
| 2011/0120037 | A1 * | 5/2011 | Barlow | E04F 15/105 | 52/309.1 |
| 2015/0305501 | A1 | 10/2015 | Brown et al. | | |

FOREIGN PATENT DOCUMENTS

| | | | |
|---|---|---|---|
| DE | 9320567 | U1 | 9/1994 |
| DE | 102016011928 | A1 | 4/2018 |
| DE | 102018110858 | A1 | 11/2019 |
| FR | 536331 | A | 12/1919 |
| KR | 20110038944 | A | 4/2011 |
| WO | 9953811 | A1 | 10/1999 |

* cited by examiner

STORAGE SYSTEM COMPRISING A PLURALITY OF CONNECTABLE PLATE-SHAPED MEMBERS

This application claims priority under 35 USC 119(a)-(d) from SE patent application No. 2051454-3 filed on Dec. 14, 2020, the entire contents of which are incorporated herein by reference.

TECHNICAL FIELD

The invention relates to a storage system for storing items, wherein the storage system comprises a plurality of plate-shaped members, wherein each one of the plate-shaped members comprises an upper support surface for supporting said items.

The storage system may for example be used as an insert in a drawer. Further, the plate-shaped member may be provided with an opening pattern in the upper support surface. The openings in the opening pattern may in turn be adapted for receipt of correspondingly shaped pegs so that the pegs project upwards from the plate-shaped member. By arranging the pegs in selected openings, a dedicated space for a subset of said items is created on the support surface of the plate-shaped member. The storage solution may for example be used for storing kitchen items, such as food containers, mixing bowls, pots, pans, lids etc. A user may then create a personal storage solution.

SUMMARY

A first object of the invention is to achieve a storage system, that creates conditions for a good fit in a drawer and providing an aesthetically attractive appearance while being cost-efficient in production.

The object is achieved by a device according to claim 1. Thus, it is achieved by a storage system for storing items, wherein the storage system comprises a plurality of plate-shaped members, wherein each one of the plate-shaped members comprises an upper support surface for supporting said items, wherein each one of two of the plate-shaped members comprises an engagement structure provided at an edge of the plate-shaped member, wherein the engagement structures are of complimentary shape and dimension for engagement, and wherein the plate-shaped members are arrangeable side by side with the engagement structures in engagement so that the plate-shaped members jointly form a continuous sheet, wherein a first one of the plate-shaped members comprises a first engagement structure provided at an edge of the first plate-shaped member, wherein a second one of the plate-shaped members comprises a second engagement structure provided at an edge of the second plate-shaped member, and wherein the first engagement structure and the second engagement structure are of complimentary shape and dimension for allowing engagement, characterized in that each one of the first plate-shaped member and the second plate-shaped member is defined by an edge extending along a straight line at an opposite side of the respective plate-shaped member in relation to the engagement structure, and wherein a third one of the plate-shaped members comprises a third engagement structure provided at an edge of the third plate-shaped member and a fourth engagement structure provided at an edge of the third plate-shaped member, wherein the third engagement structure and the fourth engagement structure face in opposite directions, wherein the third engagement structure and the first engagement structure are of complimentary shape and dimension for allowing engagement, and wherein the fourth engagement structure and the second engagement structure are of complimentary shape and dimension for allowing engagement.

In other words, the plate-shaped members are arrangeable side by side with the engagement structures in engagement so that the upper support surfaces of the plate-shaped members form a substantially uninterrupted upper support surface across the adjacent edges. Thus, the plate-shaped members are adapted for a tight fit with the engagement structures in engagement so that there is no gap between the plate-shaped members.

The engagement structures provides for a reduced risk of relative movement between the plate-shaped members in their longitudinal direction, which creates conditions for maintaining the upper support surface defined by the plate-shaped members as a continuous surface across the engaging edges. This, in turn, creates conditions for maintaining the two plate-shaped members as one sheet also when there are no walls defining the space for the storage system in the longitudinal direction.

Further, the plate-shaped members are arrangeable side by side with the engagement structures in engagement in a way that the upper support surfaces are flush.

According to one example, the plurality of plate-shaped members have the same length in a longitudinal direction of the plate-shaped members, wherein the engagement structures are provided at a lateral side edge of the respective plate-shaped member.

The first plate-shaped member and the second plate-shaped member may be arranged in direct engagement with each other.

Due to the fact that each one of the first plate-shaped member and the second plate-shaped member is defined by an edge extending along a straight line at an opposite side of the respective plate-shaped member in relation to the engagement structure, the first plate-shaped member and the second plate-shaped member may form lateral edge pieces so that the straight edges define the sheet in either direction laterally. Further, such a design of the first plate-shaped member and the second plate-shaped member creates conditions for achieving a rectangular sheet by joining a plurality of plate-shaped members side by side laterally. Further, such a design of the first plate-shaped member and the second plate-shaped member creates conditions for a modular system in that further plate-shaped members may be arranged between the end pieces.

The storage system creates conditions for a modular system in that it may comprise either only the first plate-shaped member and the second plate-shaped member as end pieces and in direct engagement with each other for an application in a space of a first width or in that the storage system may comprise the first plate-shaped member and the second plate-shaped member as end pieces and the third plate-shaped member as an intermediate piece between the end pieces and in engagement with both end pieces for an application in a space of a second width, which is larger than the first width.

According to an embodiment example, the first plate-shaped member and the second plate-shaped member are identical.

This embodiment example creates conditions for a cost-efficient manufacturing in that the same tool may be used for producing both first plate-shaped member and the second plate-shaped member.

According to a further embodiment example, a fourth one of the plate-shaped members comprises a fifth engagement structure provided at an edge of the fourth plate-shaped member and a sixth engagement structure provided at an edge of the third plate-shaped member, wherein the fifth engagement structure and the sixth engagement structure face in opposite directions, wherein the fifth engagement structure and the fourth engagement structure are of complimentary shape and dimension for allowing engagement, and wherein the sixth engagement structure and the second engagement structure are of complimentary shape and dimension for allowing engagement.

This embodiment example creates conditions for further modularity, in that the fourth plate-shaped member may be added for a space of a third width, which is larger than the width of the second space.

According to a further embodiment example, the third plate-shaped member and the fourth plate-shaped member are identical.

This embodiment example creates conditions for a cost-efficient manufacturing in that the same tool may be used for producing both the third plate-shaped member and the fourth plate-shaped member.

According to a further embodiment example, each one of the engagement structures comprises at least one projection and/or recess. Further, the at least one projection and/or recess may extend in a direction in parallel with an extension plane defined by the upper support surface. Further, the at least one projection and/or recess may extend in a lateral direction of the plate-shaped member. According to a further embodiment example, the engagement structure comprises a plurality of alternating projections and recesses in a longitudinal direction of the plate-shaped member. Preferably, the plurality of alternating projections and recesses are designed with a regularly repeated pattern in the longitudinal direction of the plate-shaped member. According to one example, the engagement structure has a shape defining smooth transitions between the plurality of alternating projections and recesses. According to a further example, the engagement structure has a wave shape with smoothly rounded projections and recesses, such as a sine wave. According to an alternative, the engagement structure is adapted for more abrupt transitions between the projections and recesses, such as a square, triangular, sawtooth or dovetail shape.

According to a further embodiment example, the storage system comprises a connection arrangement for maintaining two adjacent plate-shaped members in an engaged state and wherein the connection arrangement is arranged at an opposite side of the respective plate-shaped member in relation to its upper support surface.

This embodiment example creates conditions for maintaining adjacent plate-shaped members in a tight fit laterally in an aesthetically attractive way.

According to a further embodiment example, each one of the plurality of plate-shaped members comprises a plurality of openings in the support surface, wherein each opening is adapted for receipt of an end portion of a peg so that the peg may be arranged projecting from the plate-shaped member and defining a dedicated space for a subset of said items on the support surface of the plate-shaped member.

Arranging the openings in a proper pattern creates conditions for flexibility in solutions for storage of items. More specifically, a user may arrange the pegs in a multiplicity of different ways for defining one or several sub-spaces on the upper support surface for different items.

According to a further embodiment example, the openings in the support surface are arranged in a plurality of parallel rows which extend in a lateral direction of the plate-shaped member, wherein the openings in every second row of the plurality of rows are arranged in an offset relationship in relation to the openings in the other rows, and wherein the edge of the plate-shaped member provided with the engagement structure extend at substantially the same distance from the nearest opening in each row so that the edge forms a zigzag shape.

Arranging the openings in a pattern of parallel rows with said offset between the openings in adjacent rows creates conditions for an optimum strength of the plate-shaped member. Further, designing the plate-shaped members so that the edge is at a distance from the nearest opening creates further conditions for an optimum strength of the plate-shaped member.

According to a further embodiment example, the openings in the support surface are elongated and wherein the openings are arranged so that a main axis of the elongated shape extend in parallel with the longitudinal direction of the rows.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS

Figure 1:
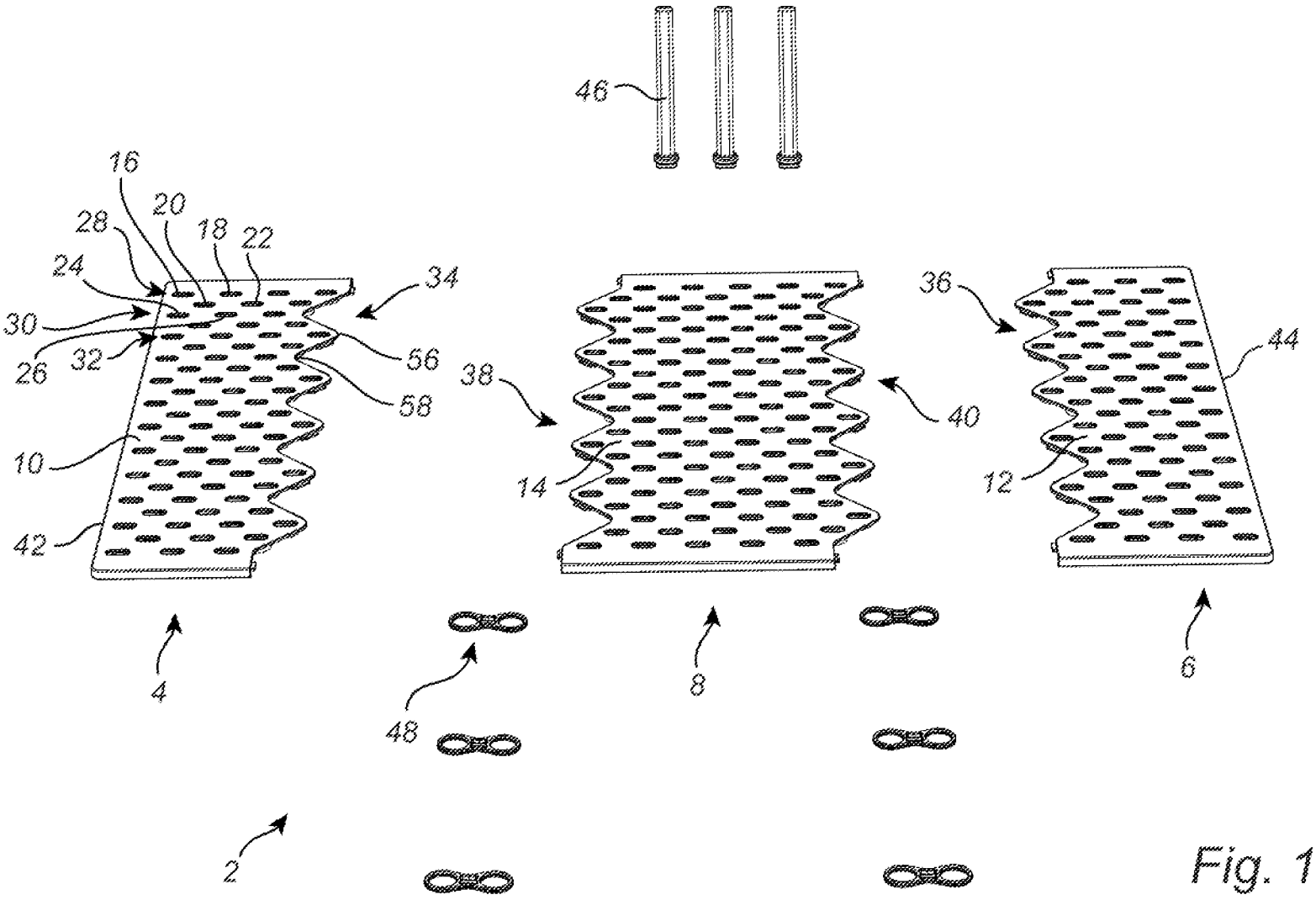
FIG. 1 shows a storage system according to a first embodiment in an exploded view.

FIG. 1 shows a storage system 2 for storing items according to a first embodiment in an exploded view. The storage system comprises a plurality of plate-shaped members 4, 6, 8, wherein each one of the plate-shaped members comprises an upper support surface 10, 12, 14 for supporting said items.

Each one of the plurality of plate-shaped members 4, 6, 8 comprises a plurality of openings 16, 18, 20, 22, 24, 26 in the support surface, wherein each opening is adapted for receipt of an end portion of a peg 46 so that the peg may be arranged projecting from the plate-shaped member and defining a dedicated space for a subset of said items on the support surface of the plate-shaped member. The upper support surface 10, 12, 14 of each plate-shaped member 4, 6, 8 forms a continuous flat surface interrupted only by the openings.

More specifically, the openings in the support surface are arranged in a plurality of parallel rows 28, 30, 32, which extend in a lateral direction of the respective plate-shaped member 4. Further, each one of the rows 28, 30, 32 extends along a straight line. The openings in each row are regularly spaced. In other words, the openings in each row are arranged with equal distance between two adjacent openings. Further, the openings in every second row 28, 32 of the plurality of rows are arranged in an offset relationship in relation to the openings in the intermediate row 30. Further, the openings in two adjacent rows are arranged with identical spacing between the openings in each row.

Further, the openings are elongated and the openings are arranged so that a main axis of the elongated shape extend in parallel with the longitudinal direction of the rows. Further, the spacing between adjacent openings in one row is the same or somewhat larger than an extension of an opening in the direction of its main axis. Further, the openings in every second row 28, 32 of the plurality of rows are arranged in a regular offset relationship in relation to the openings in the intermediate row 30 so that there is no or a minimum of overlap between two adjacent openings in two adjacent rows in a direction perpendicular to the extension direction of the rows. Further, the spacing between adjacent rows perpendicular to an extension direction of the rows is the same or somewhat larger than an extension of an opening in the direction of its main axis.

Further, all openings on one of said plate-shaped members have the same shape and size. Further, the plurality of openings in the plate-shaped members are formed by through holes extending throughout the thickness of a plate section which defines the upper support surface.

Each one of the plate-shaped members 4, 6, 8 comprises at least one engagement structure 34, 36, 38, 40 provided at an edge of the plate-shaped member. More specifically, a first one 4 of the plate-shaped members comprises a first engagement structure 34 provided at an edge of the first plate-shaped member 4. Further, the first plate-shaped member 4 is defined by an edge 42 extending along a straight line at an opposite side of the plate-shaped member in relation to the engagement structure 34. In a similar way, a second one 6 of the plate-shaped members comprises a second engagement structure 36 provided at an edge of the second plate-shaped member 6. Further, the second plate-shaped member 6 is defined by an edge 44 extending along a straight line at an opposite side of the plate-shaped member in relation to the engagement structure 36.

The first plate-shaped member 4 and the second plate-shaped member 6 are identical. Further, the first plate-shaped member 4 and the second plate-shaped member 6 are arranged in the same extension plane so that the engagement structures 34, 36 face each other.

A third one 8 of the plate-shaped members comprises a third engagement structure 38 provided at an edge of the third plate-shaped member and a fourth engagement structure provided at an edge of the third plate-shaped member, wherein the third engagement structure 38 and the fourth engagement structure 40 face in opposite directions. The third engagement structure 38 and the first engagement structure 34 of the first plate-shaped member 4 are of complimentary shape and dimension for allowing engagement. Further, the fourth engagement structure 40 and the second engagement structure 36 of the second plate-shaped member 6 are of complimentary shape and dimension for allowing engagement.

Each one of the engagement structures 34, 36, 38, 40 is arranged in a way that the associated edge of the plate-shaped member does not intersect any one of the openings.

Due to the opening pattern with an offset relationship of the holes in adjacent rows, the edge of the plate-shaped member has a zigzag shape. More specifically, each one of the engagement structures 34, 36, 38, 40 comprises at least one projection 56 and/or recess 58. More specifically, the at least one projection and/or recess extend in a direction in parallel with an extension plane defined by the upper support surface 10. More specifically, a demarcation line of the upper support surface 10 is defined by an outer boundary of the at least one projection 56 and/or recess 58. Further, the at least one projection 56 and/or the at least one recess 58 has a curved shape at its tip and bottom, respectively. More specifically, the engagement structure 34 comprises a plurality of alternating projections and recesses in a regular pattern along the complete lateral side of the plate-shaped member.

The storage system 2 further comprises a plurality of pegs 46 for being positioned in selected ones of the openings. The arrangement of the pegs 46 in the openings will be described in more detail in association with FIGS. 7, 8A, 8B, 8C and 8D.

The storage system 2 further comprises a connection arrangement 48 for maintaining two adjacent plate-shaped members in an engaged state. The connection arrangement 48 is arranged at an opposite side of the respective plate-shaped member in relation to its upper support surface and will be described in more detail in association with FIGS. 5A, 5B and 5C.

Figure 2:
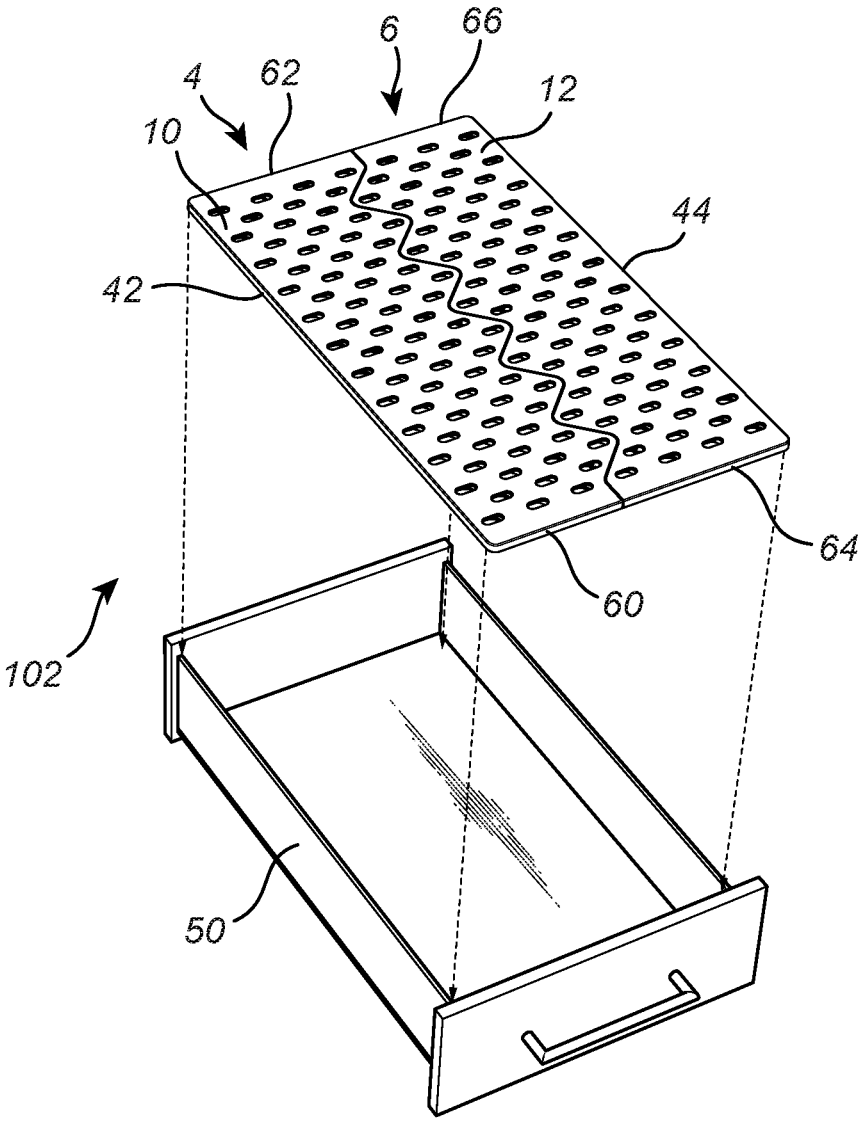
FIG. 2 shows a storage system according to a second embodiment for application in a drawer of a first width.

Turning now to FIG. 2. FIG. 2 shows a storage system 102 according to a second embodiment for application in a drawer 50 of a first width. According to one example, the first drawer has an internal width of 40 cm. The storage system 102 comprises the first plate-shaped member 4 and the second plate-shaped member 6. The engagement structures 34, 36 of the plate-shaped members 4, 6 are of complimentary shape and dimension for engagement. Further, the plate-shaped members 4, 6 are arrangeable side by side with the engagement structures 34, 36 in engagement so that the plate-shaped members jointly form a continuous sheet or board. More specifically, the upper support surfaces 10, 12 of the plate-shaped members 4, 6 form an uninterrupted upper support surface across the adjacent edges defined by the engagement structures 34, 36. In other words, the plate-shaped members 4, 6 are adapted for a tight fit when the at least one projection and the at least one recess are in a mating configuration so that there is no gap between the plate-shaped members. Further, the upper surfaces of the plate-shaped members 4, 6 are flush when the plate-shaped members 4, 6 are arranged in engagement.

A lateral extension of the respective plate-shaped members 4,6 are adapted so that a total lateral extension of the sheet is such that the sheet fits in the drawer 50. Further, the plate-shaped members 4, 6 have the same length in a longitudinal direction of the plate-shaped members. More specifically, opposite edges 60, 62 and 64, 66, respectively, in a longitudinal direction of each one of the plate-shaped members 4, 6 extend along straight lines, which are in parallel with each other. Further, the straight opposite edges 60, 62 and 64, 66, respectively, extend perpendicularly relative to the extension direction of the straight lateral edge 42, 44. Further, a mean line extending midway between the tips of the projections and the bottoms of the recesses in the engagement structure has a straight extension, which is in parallel with the respective straight lateral edge 42, 44. In this way, the sheet or board will have a rectangular shape when the plate-shaped members 4,6 are in engagement. Each one of the plate-shaped members 4,6 has a width in the lateral direction between the straight edge 42, 44 and the mean line defining the engagement structure of 20 cm, or somewhat smaller than 20 cm. A total width of the sheet comprising both plate-shaped members 4,6 is about 40 cm or somewhat smaller for a good lateral fit in the drawer 50.

Figure 3:
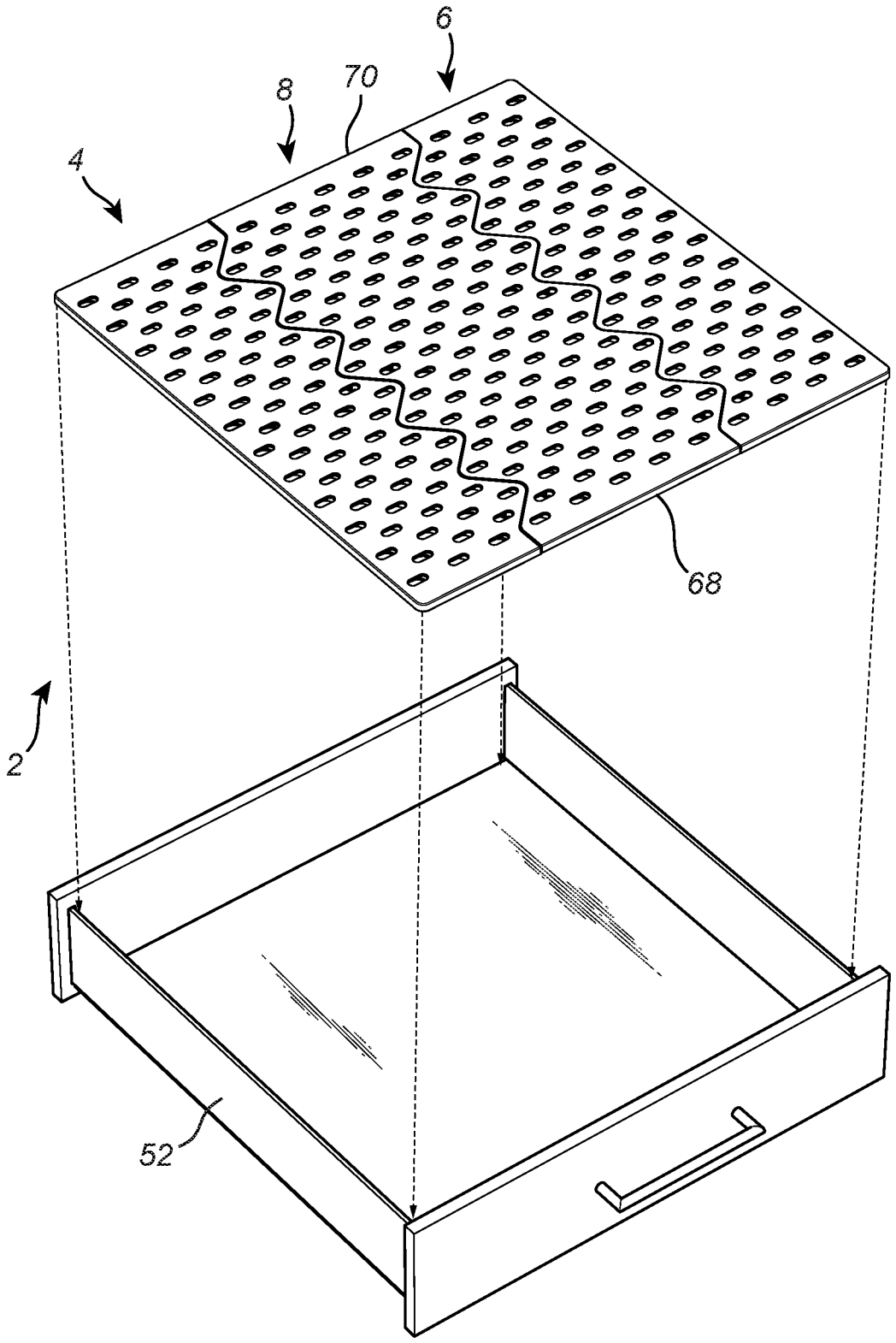
FIG. 3 shows a storage system according to the first embodiment for application in a drawer of a second width.

Turning now to FIG. 3. FIG. 3 shows a storage system 2 according to the first embodiment for application in a second drawer 52 of a second width, which is larger than the first width of the first drawer 50. According to one example, the second drawer has an internal width of 60 cm. The second drawer 52 has the same extension as the first drawer in a longitudinal direction. The storage system 2 comprises the first plate-shaped member 4 and the second plate-shaped member 6, which form edge pieces in a lateral direction. Further, the storage system 2 comprises the third plate-shaped member 8, which forms an intermediate piece between the first plate-shaped member 4 and the second plate-shaped member 6. Further, the third plate-shaped member 8 is in engagement with each one of the first plate-shaped member 4 and the second plate-shaped member 6 via the engagement structures 34, 38 and 36, 40, respectively.

Further, the third plate-shaped member 8 has the same length in a longitudinal direction of the plate-shaped members as the first and second plate-shaped members 4, 6. More specifically, opposite edges 68, 70 in a longitudinal direction of the third plate-shaped member 8 extend along straight lines, which are in parallel with each other. Further, a mean line extending midway between the tips of the projections and the bottoms of the recesses in each one of the engagement structures 38, 40 has a straight extension, which are in parallel with each other. Further, the straight opposite edges 68, 70 extend perpendicularly relative to the extension direction of the straight mean lines of the lateral edges. In this way, the sheet or board will have a rectangular shape when the plate-shaped members 4,6,8 are in engagement. The third plate-shaped member 8 has a width in the lateral direction between the straight mean lines defining the engagement structures of 20 cm, or somewhat smaller than 20 cm. A total width of the sheet comprising the first, second and third plate-shaped members 4, 6, 8 is about 60 cm or somewhat smaller for a good lateral fit in the drawer 52.

Figure 4:
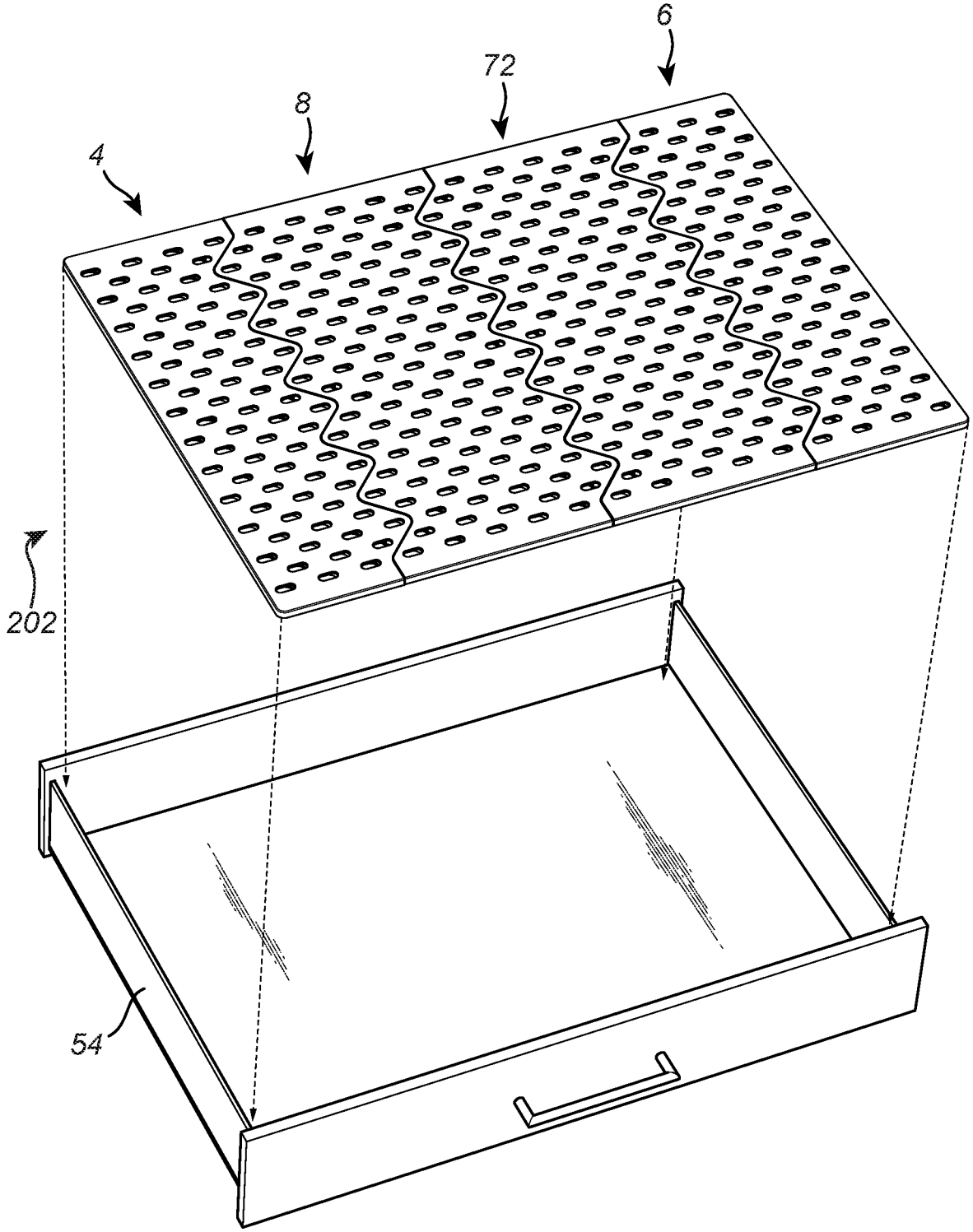
FIG. 4 shows a storage system according to a third embodiment for application in a drawer of a third width.

Turning now to FIG. 4. FIG. 4 shows a storage system 202 according to a third embodiment for application in a third drawer 54 of a third width, which is larger than the second width of the second drawer 52. According to one example, the third drawer has an internal width of 80 cm. The third drawer 54 has the same extension as the first drawer in a longitudinal direction. The storage system 202 comprises the first plate-shaped member 4 and the second plate-shaped member 6, which form edge pieces in a lateral direction. Further, the storage system 2 comprises the third plate-shaped member 8, which forms an intermediate piece between the first plate-shaped member 4 and the second plate-shaped member 6. Further, the storage system 2 comprises a fourth plate-shaped member 72. Also the fourth plate-shaped member 72 forms an intermediate pieces between the first plate-shaped member 4 and the second plate-shaped member 6. The third plate-shaped member 8 and the fourth plate-shaped member 72 are identical. The third plate-shaped member 8 and the fourth plate-shaped member 72 are arranged in engagement with each other. The third plate-shaped member 8 forms an intermediate piece between the first plate-shaped member 4 and the fourth plate-shaped member 72. Further, the third plate-shaped member 8 is in engagement with each one of the first plate-shaped member 4 and the fourth plate-shaped member 72. Likewise, the fourth plate-shaped member 72 forms an intermediate piece between the third plate-shaped member 8 and the second plate-shaped member 6. Further, the fourth plate-shaped member 72 is in engagement with each one of the third plate-shaped member 8 and the second plate-shaped member 6. A total width of the sheet comprising the first, second, third and fourth plate-shaped members 4, 6, 8, 72 is about 80 cm or somewhat smaller for a good lateral fit in the drawer 54.

Figure 5A:
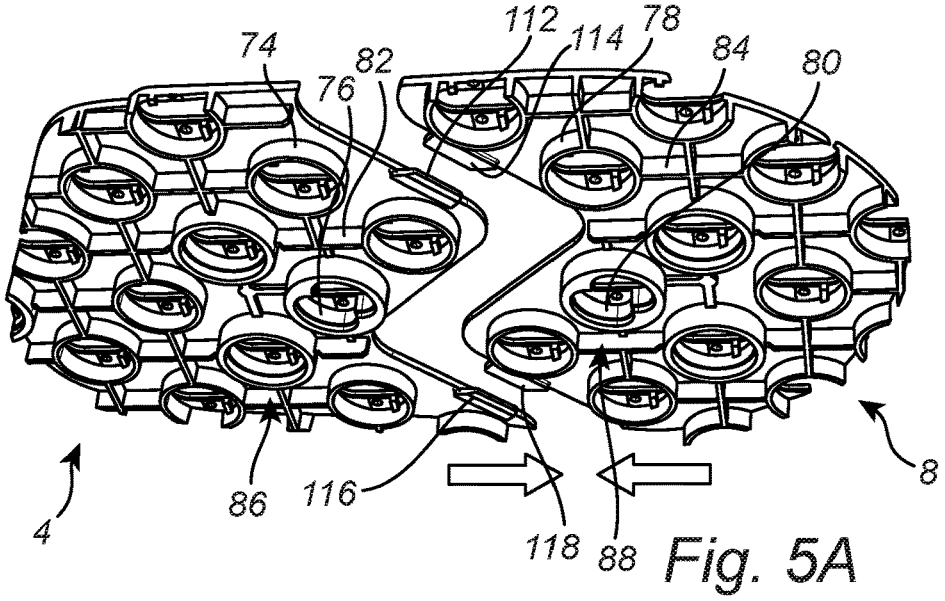
FIG. 5A shows a connection interface between two adjacent plate-shaped members in a perspective view from below in a first step of a connection procedure.

FIG. 5A shows a connection interface between two adjacent plate-shaped members 4, 8 in a perspective view from below in a first step of a connection procedure. Each one of the plate-shaped members 4, 8 comprises a plurality of tubular portions 74, 76 and 78, 80, respectively. The tubular portions 74, 76 and 78, 80 project perpendicularly relative to the plate section that defines the upper support surface. More specifically, the tubular portions 74, 76 and 78, 80 project from a lower surface of the plate section that is opposite the upper support surface. Further, each one of the tubular portions 74, 76 and 78, 80 is aligned with one of said elongated openings, wherein the tubular portions 74, 76 and 78, 80 are arranged in rows in a similar pattern as has been described for the openings. The tubular portions 74, 76 and 78, 80 are formed in a one-piece unit with the plate section.

Further, each one of the plate-shaped members 4, 8 comprises a network of straight ribs 82, 84, which interconnect adjacent tubular portions 74, 76 and 78, 80. A first set of the straight ribs extend in parallel with the rows of tubular portions 74, 76 and 78, 80 interconnecting adjacent tubular portions in each row. A second set of the straight ribs extend perpendicular to the rows of tubular portions 74, 76 and 78, 80 and interconnecting tubular portions in every second row. The ribs are formed in a one-piece unit with the plate section.

Further, each one of the plate-shaped members 4, 8 comprises at least one engagement tooth 112, 114 and 116, 118, respectively, which are adapted for engagement. Each one of the teeth 112, 114 and 116, 118 projects from an edge of the respective plate defined by the engagement structure 34, 38. More specifically, each one of the plate-shaped members 4, 8 comprises a plurality of engagement teeth 112, 114, which are spaced in an extension direction of the engagement structure.

Each one of the plate-shaped members 4, 6, 8, 72 is made of a plastic material. The plate-shaped members 4, 6, 8, 72 may be manufactured via injection moulding.

The storage system 2 further comprises a plurality of friction means 86, 88 distributed over a lower surface of the plate-shaped members opposite the upper support surface for creating an increased friction against an external support surface. The friction means 86, 88 comprises at least one ring adapted to be fitted to one of said tubular portions. More specifically, the friction means 86, 88 comprises three rings, which are arranged in a triangular shape and connected via connectors. The friction means 86, 88 may be formed by rubber, such as synthetic rubber, for example TPE. The friction means 86, 88 may be manufactured in association with the manufacturing of the plate-shaped members 4, 6, 8, 72 such as via double injection moulding.

Figure 6:
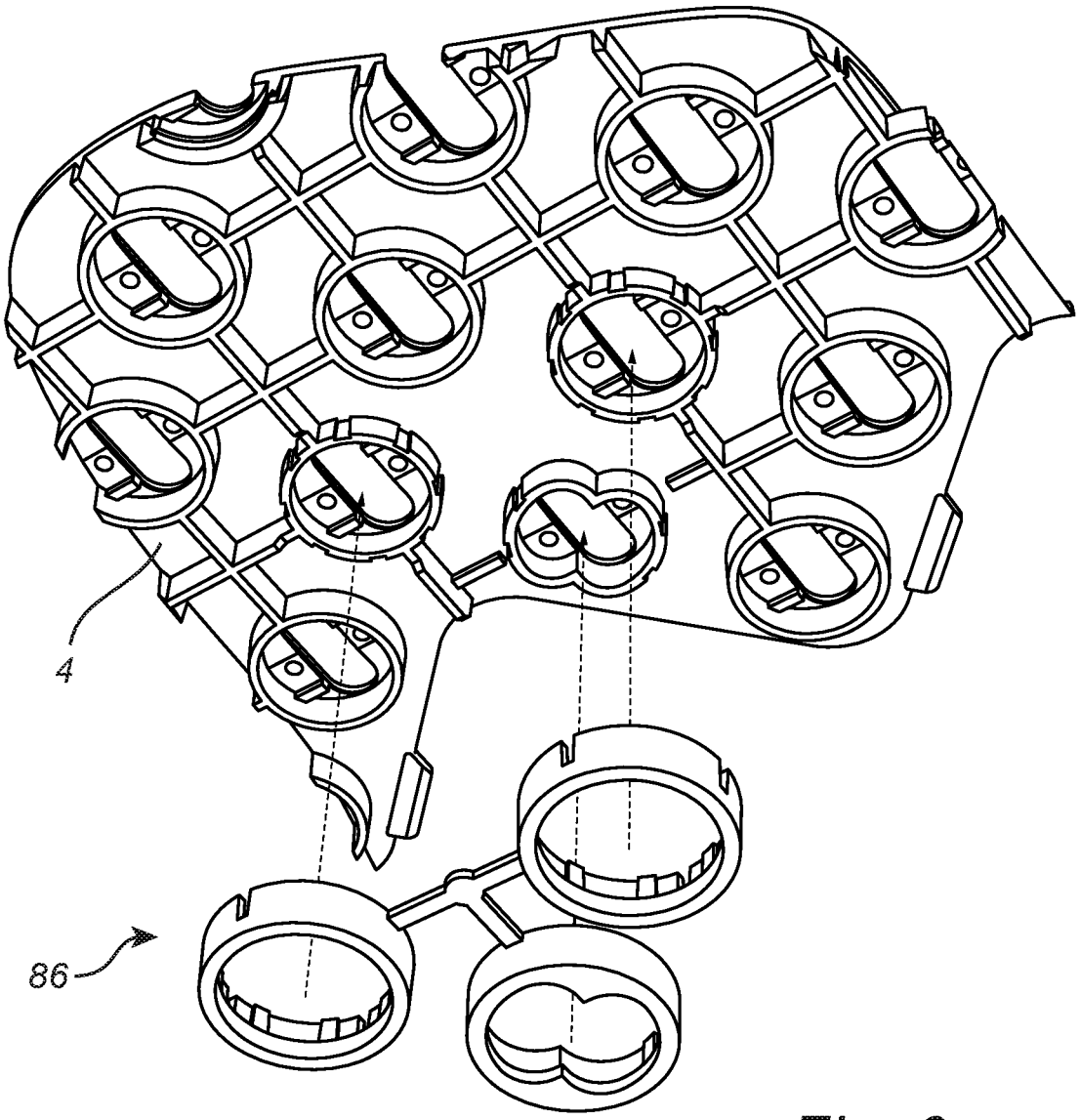
FIG. 6 shows a friction means for contacting an external surface according to FIGS. 5A, 5B and 5C.

FIG. 6 shows the friction means 86 in a state removed from the plate-shaped member 4. The friction means 86 is formed by a one-piece body.

The arrows in FIG. 5A indicate a relative movement direction of the plate-shaped members 4, 8 for engagement via the engagement structures 34, 38.

Figure 5B:
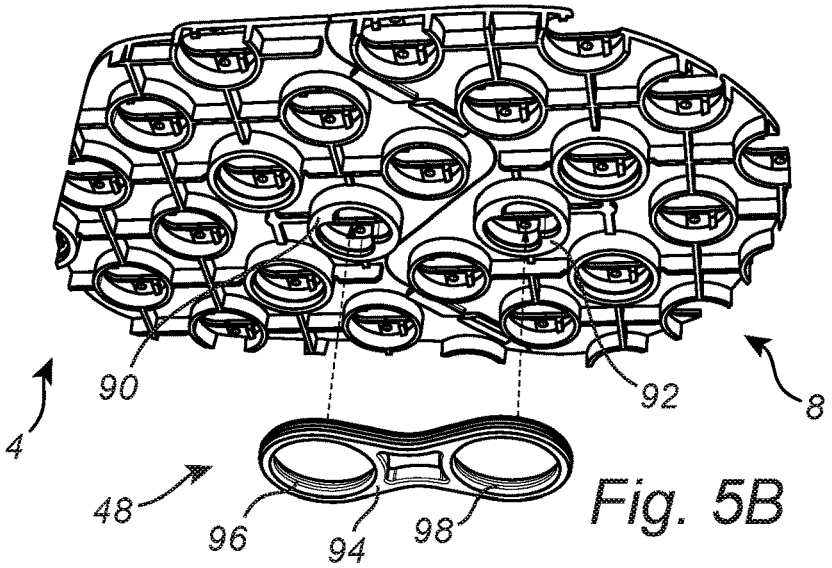
FIG. 5B shows the connection interface between two adjacent plate-shaped members according to FIG. 5A in a perspective view from below in a second step of a connection procedure.

FIG. 5B shows the connection interface between the two adjacent plate-shaped members 4, 8 according to FIG. 5A in a perspective view from below in a second step of a connection procedure.

The storage system comprises a connection arrangement 48 for maintaining two adjacent plate-shaped members 4, 8 in an engaged state. The connection arrangement 48 is arranged at an opposite side of the respective plate-shaped member 4, 8 in relation to its upper support surface. The connection arrangement comprises a connection means 90, 92 provided at each one of the plate-shaped members 4, 8 in the vicinity of the engagement structure and a connection element 94, which is adapted for simultaneous engagement with the connection means 90, 92 of each one of the two adjacent plate-shaped members. Each one of the connection means 90, 92 comprises a projecting portion and the connection element 94 comprises two spaced recesses 96, 98, which are adapted for engagement with the two projecting portions.

More specifically, the connection means 90, 92 of the connection arrangement is formed by one of the rings of one of the friction means 86, 88. Thus, the friction means 86, 88 has two functions; forming a proper friction against an external surface so that the plate-shaped member is held in place and forming a part of the connection arrangement for interconnection with an adjacent plate-shaped member.

Further, the connection element 94 is formed by a one-piece body with two loops, which defines the two spaced recesses 96, 98. The connection element 94 has a main extension in a plane and is formed by a flexible material. The connection element 94 is moved to its operative position engaging the rings of the friction means and thereby bridging the two adjacent plate-shaped members 4, 8, via a movement towards the plate-shaped members.

Figure 5C:
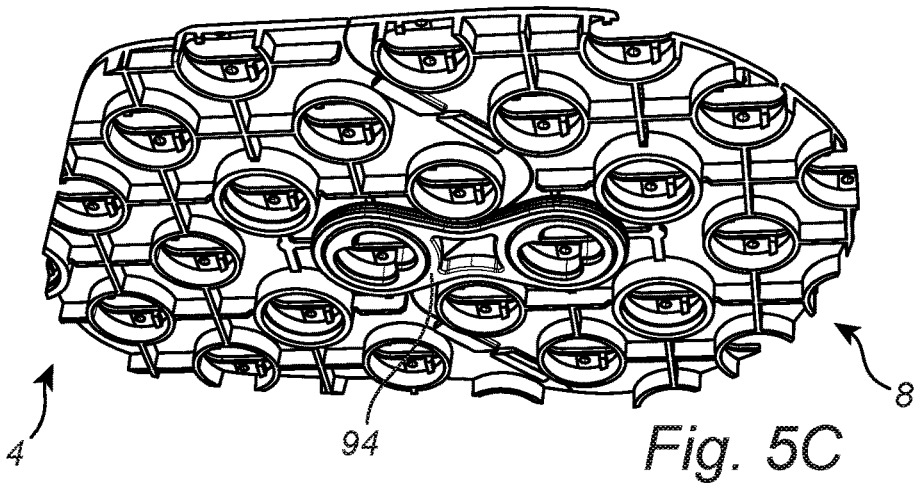
FIG. 5C shows the connection interface between two adjacent plate-shaped members according to FIG. 5A in a perspective view from below in a third step of a connection procedure.

FIG. 5C shows the connection interface between the two adjacent plate-shaped members 4, 8 according to FIG. 5A in a perspective view from below in a third step of a connection procedure, wherein the connection element 94 is arranged in its operative state.

Figure 7:
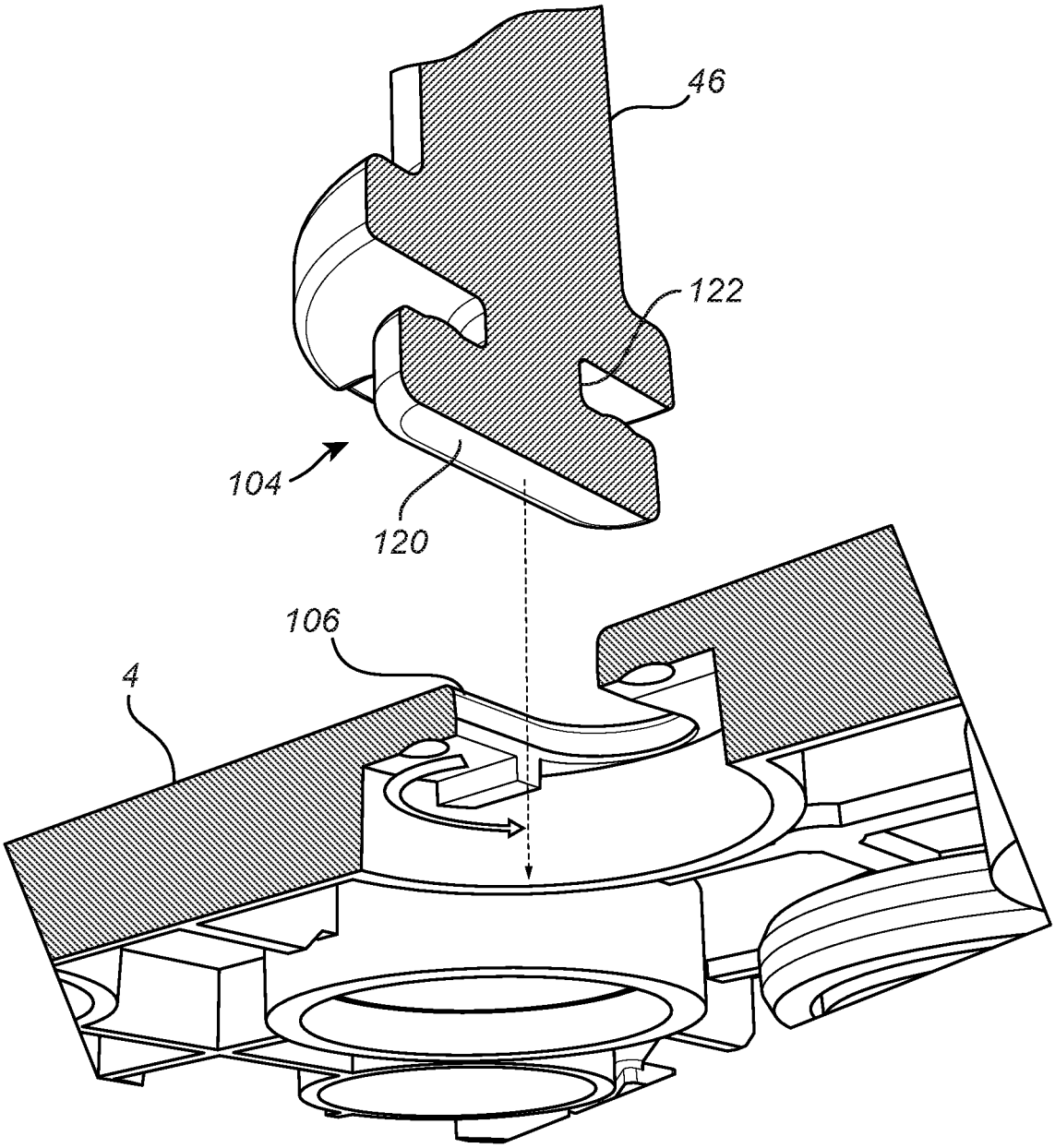
FIG. 7 shows a peg in a partly cut view from below.

FIG. 7 shows the peg 46 in a partly cut view from below in relation to an associated opening 106 in the plate-shaped member 4. The peg 4 has a first end 104, which is adapted for being inserted into the opening 106. More specifically, the first end 104 has an outer portion 120 with an elongated cross section shape similar to the cross section shape of the opening 106. Further, the first end 104 of the peg 46 has a portion 122 with a reduced cross section adjacent the outer portion 120. The portion 122 with a reduced cross section is designed so that the peg may be turned (see arrow) after the outer portion 120 of the peg has been inserted in the opening 106 and passed the plate section defining the opening.

Figure 8A:
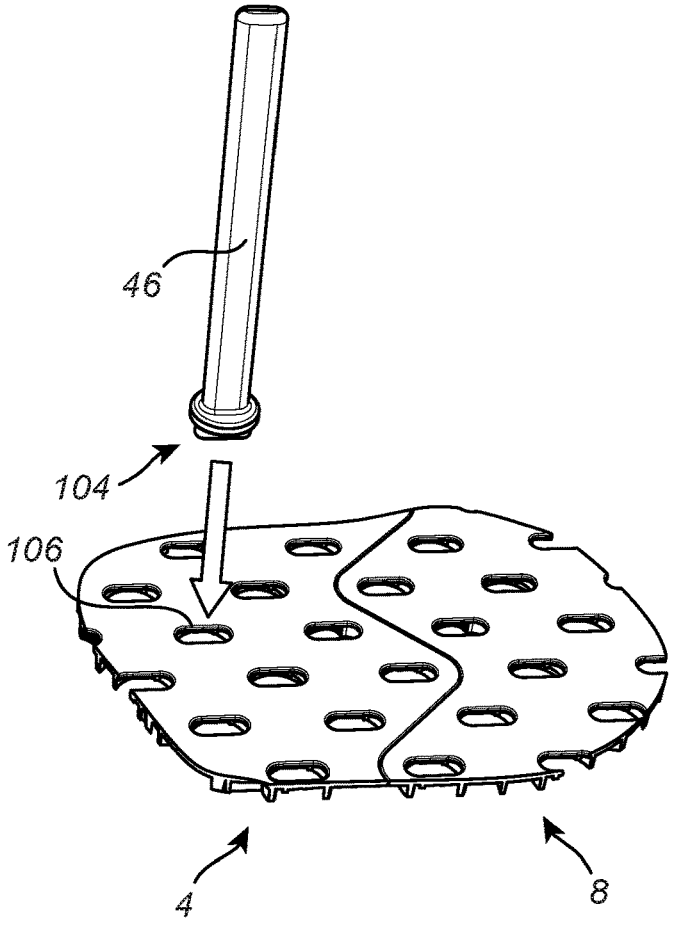
FIG. 8A shows a connection interface between a peg and a plate-shaped member in a perspective view from above in a first step of a connection procedure.

FIG. 8A shows a connection interface between the peg 46 and the plate-shaped member 4 in a perspective view from above in a first step of a connection procedure. The peg 46 is moved in its extension direction, see arrow, so that the first end 104 is received in the selected opening 106.

Figure 8B:
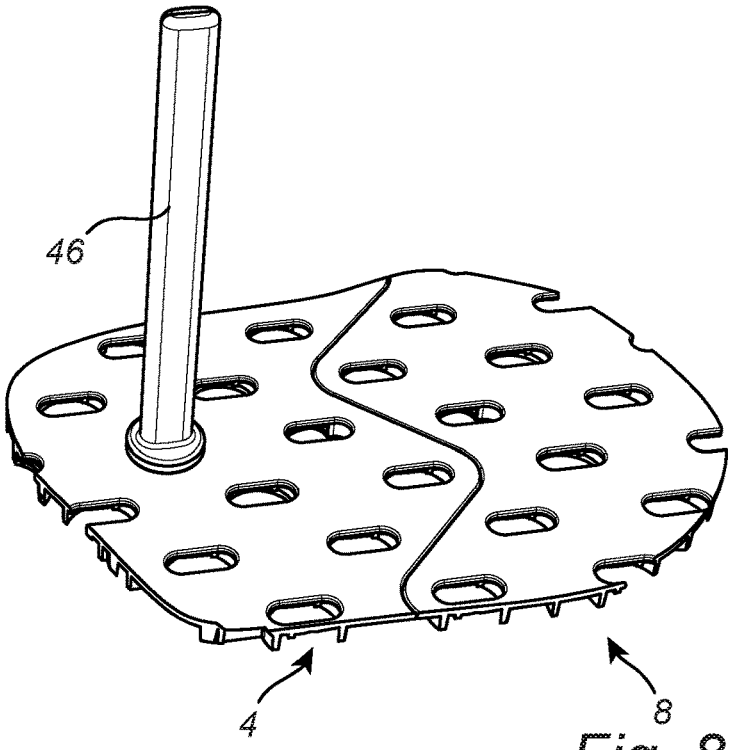
FIG. 8B shows the connection interface between the peg and the plate-shaped member according to FIG. 8A in a perspective view from above in a second step of a connection procedure.

FIG. 8B shows the connection interface between the peg 46 and the plate-shaped member 4 according to FIG. 8A in a perspective view from above when the peg 46 is received in the opening.

Figure 8C:
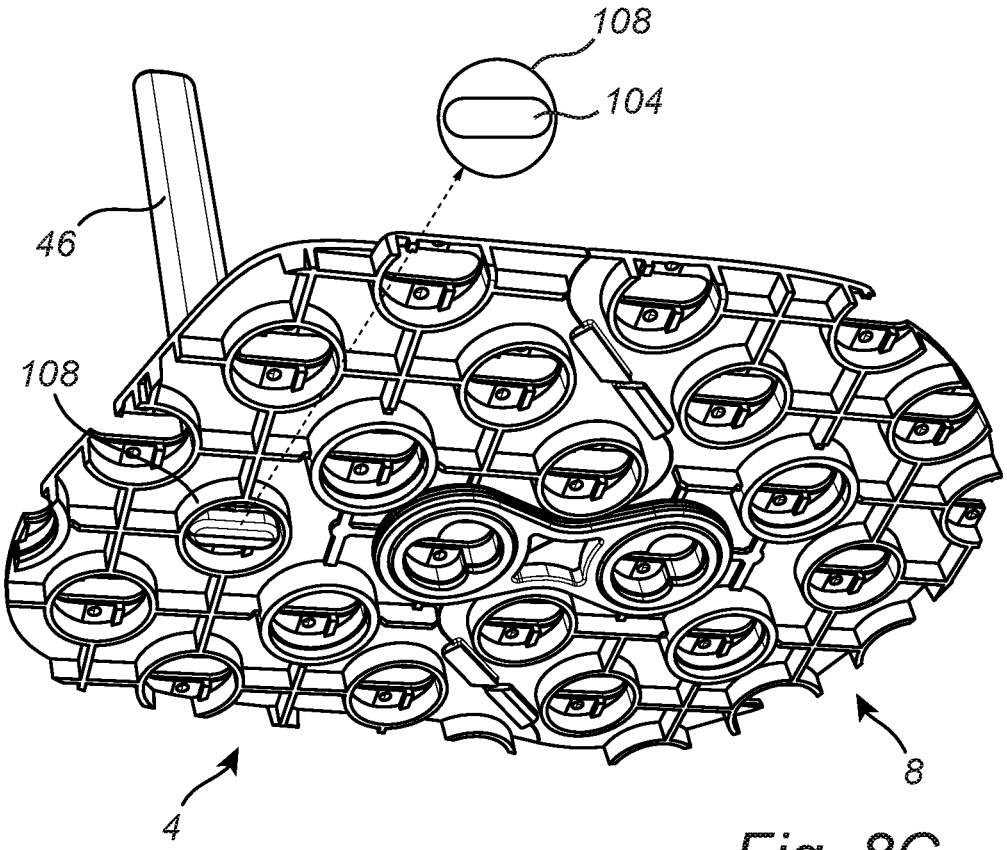
FIG. 8C shows the connection interface between the peg and the plate-shaped member according to FIG. 8B in a perspective view from below.

FIG. 8C shows the connection interface between the peg and the plate-shaped member according to FIG. 8B in a perspective view from below. The tubular portions 108 on the underside of the plate-shaped members has a circular inner cross section. Further, each one of the tubular portions 108 is in communication with a respective one of said elongated openings 106. Further, an inner surface of the circular tubular portion 108 has a diameter, which is commensurate with a length of the associated opening 106.

Figure 8D:
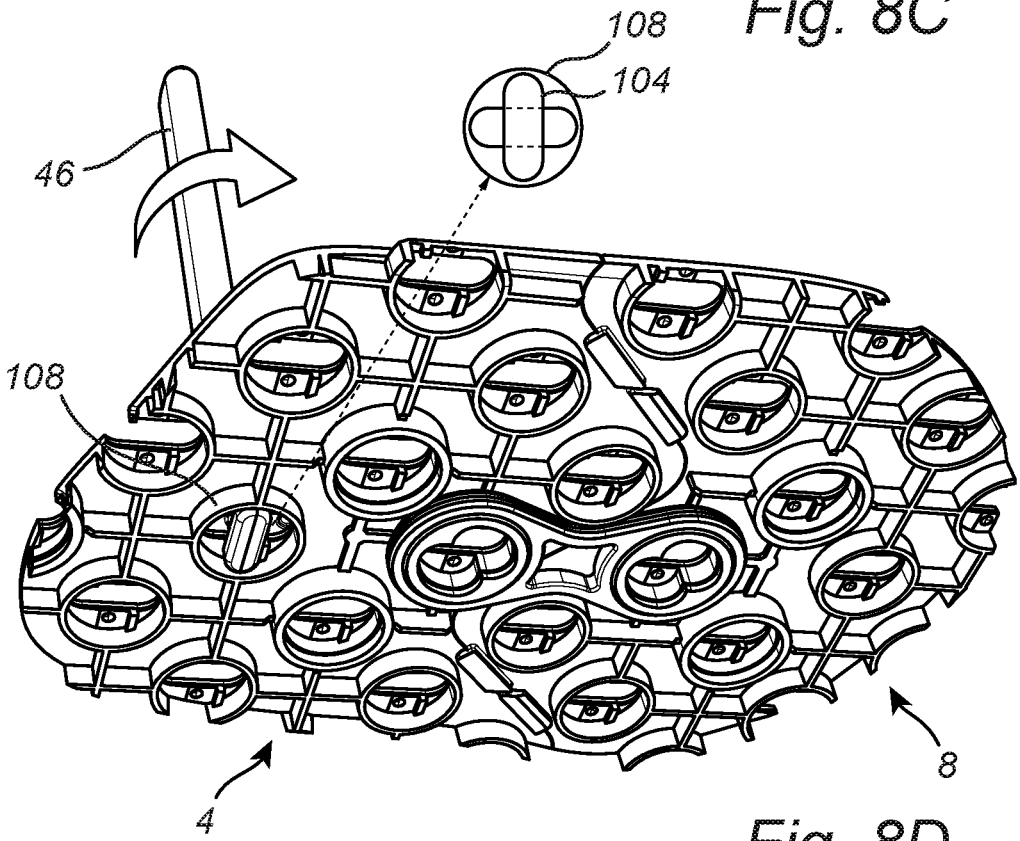
FIG. 8D shows the connection interface between the peg and the plate-shaped member according to FIG. 8C in a perspective view from below in a third step of a connection procedure.

FIG. 8D shows the connection interface between the peg 46 and the plate-shaped member 4 according to FIG. 8C in a perspective view from below in a third step of a connection procedure. The peg 46 is pivoted 90 degrees about an axis in its extension direction so that the elongated end portion 104 is locked on an underside of the plate. In this way, the peg 46 is secured in its operative state and obstructed from an undesired release from the plate-shaped member 4.

Figure 9:
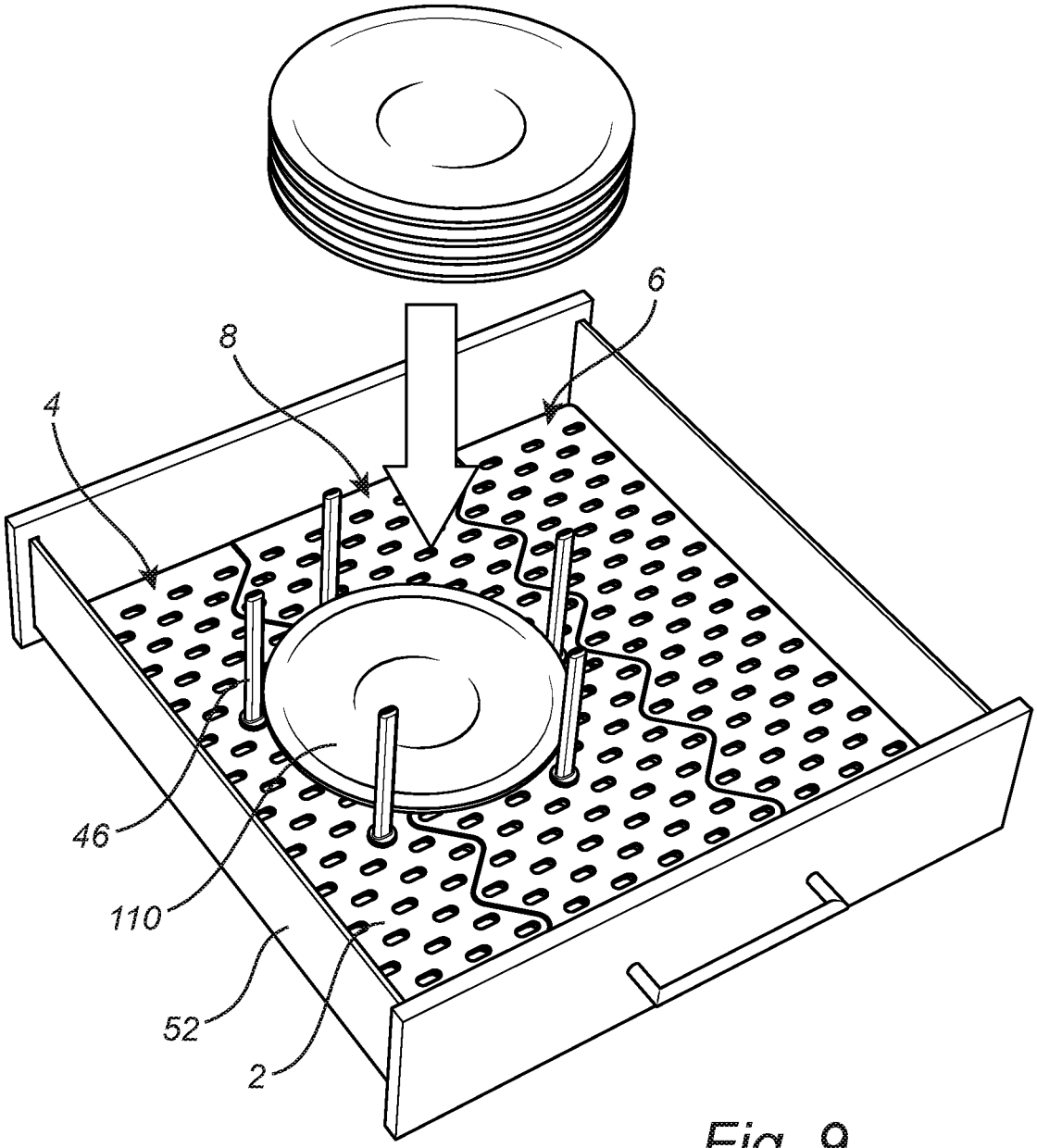
FIG. 9 shows the storage system according to the first embodiment applied in a drawer with pegs applied for organizing a set of plates.

FIG. 9 shows the storage system 2 according to the first embodiment applied in a drawer with pegs 46 applied for organizing items 110 in the form of a set of plates.

It is to be understood that the present invention is not limited to the embodiments described above and illustrated in the drawings; rather, the skilled person will recognize that many changes and modifications may be made within the scope of the appended claims.

One possible alternative is that the interface between two plate-shaped members is formed by a straight line seen from above and that the engagement structures are arranged for engagement below a plate section, that defines the upper surface.

For matching drawers of different widths, the intermediate piece may be of different width in the lateral direction than an end piece. Further, two intermediate pieces may be of different widths in the lateral direction. Further, two end pieces may be of different widths in the lateral direction.

Further, the connection means of the plate-shaped member may not necessarily be formed by the friction means. For example, the connection means of the plate-shaped member may be formed by the tubular portion projecting from the plate section of the plate-shaped member.

The invention claimed is:

1. A storage system for storing items, the storage system comprising:

a plurality of plate-shaped members, wherein each one of the plate-shaped members includes an upper support surface for supporting the items;

wherein each one of two of the plate-shaped members includes an engagement structure provided at an edge of the plate-shaped member, wherein the engagement structures are of complimentary shape and dimension for engagement, and wherein the plate-shaped members are arrangeable side by side with the engagement structures in engagement so that the plate-shaped members jointly form a continuous sheet;

wherein a first one of the plate-shaped members includes a first engagement structure provided at an edge of the first plate-shaped member, wherein a second one of the plate-shaped members includes a second engagement structure provided at an edge of the second plate-shaped member, and wherein the first engagement structure and the second engagement structure are of complimentary shape and dimension for allowing engagement;

wherein each one of the first plate-shaped member and the second plate-shaped member is defined by an edge extending along a straight line at an opposite side of the respective plate-shaped member in relation to the engagement structure;

wherein a third one of the plate-shaped members includes a third engagement structure provided at an edge of the third plate-shaped member and a fourth engagement structure provided at an edge of the third plate-shaped member, wherein the third engagement structure and the fourth engagement structure face in opposite directions;

wherein the third engagement structure and the first engagement structure are of complimentary shape and dimension for allowing engagement, and wherein the fourth engagement structure and the second engagement structure are of complimentary shape and dimension for allowing engagement;

a plurality of friction means distributed over a lower surface of the plate-shaped members opposite the upper support surface, the plurality of friction means for creating an increased friction against an external support surface, and for receiving a connection element that interconnects adjacent plate-shaped members.

2. The storage system according to claim 1, wherein the first plate-shaped member and the second plate-shaped member are identical.

3. The storage system according to claim 1, wherein a fourth one of the plate-shaped members comprises a fifth engagement structure provided at an edge of the fourth plate-shaped member and a sixth engagement structure provided at an edge of the fourth plate-shaped member, wherein the fifth engagement structure and the sixth engagement structure face in opposite directions;

wherein the fifth engagement structure and the fourth engagement structure are of complimentary shape and dimension for allowing engagement, and wherein the sixth engagement structure and the second engagement structure are of complimentary shape and dimension for allowing engagement.

4. The storage system according to claim 3, wherein the third plate-shaped member and the fourth plate-shaped member are identical.

5. The storage system according to claim 1, wherein each one of the engagement structures comprises at least one projection and/or recess.

6. The storage system according to claim 5, wherein the at least one projection and/or recess extends in a direction in parallel with an extension plane defined by the upper support surface.

7. The storage system according to claim 5, wherein the engagement structure comprises a plurality of alternating projections and recesses.

8. The storage system according to claim 1, wherein the storage system comprises a connection arrangement for maintaining two adjacent plate-shaped members in an engaged state; and wherein the connection arrangement is arranged at an opposite side of the respective plate-shaped member in relation to its upper support surface.

9. The storage system according to claim 8, wherein the connection arrangement comprises the plurality of friction means respectively provided at each one of the plate-shaped members in the vicinity of the engagement structure and the connection element, which is adapted for simultaneous engagement with the friction means of each one of the two adjacent plate-shaped members.

10. The storage system according to claim 9, wherein each one of the friction means comprises a projecting portion and the connection element comprises two spaced recesses, which are adapted for engagement with the two projecting portions.

11. The storage system according to claim 1, wherein each one of the plurality of plate-shaped members includes a plurality of openings in the upper support surface;

wherein each opening is configured to receive an end portion of a peg so that the peg may be arranged projecting from the plate-shaped member and defining a dedicated space for a subset of the items on the support surface of the plate-shaped member.

12. The storage system according to claim 11, wherein the openings in the support surface are arranged in a plurality of parallel rows which extend in a lateral direction of the plate-shaped member;

wherein the openings in every second row of the plurality of rows are arranged in an offset relationship in relation to the openings in the other rows; and wherein the edge of the plate-shaped member provided with the engagement structure extend at substantially the same distance from the nearest opening in each row so that the edge forms a zigzag shape.

13. The storage system according to claim 12, wherein the openings in the support surface have an elongated shape; and wherein the openings are arranged so that a main axis of the elongated shape extends in parallel with the longitudinal direction of the rows.

14. The storage system according to claim 11, wherein the peg is rotatable about an axis that extends along a length of the peg to lock the peg to the plate-shaped member.

* * * * *